US005279371A

United States Patent [19]

Ekwall et al.

[11] Patent Number: 5,279,371

[45] Date of Patent: Jan. 18, 1994

[54] DOWN-THE-HOLE DRILLING MACHINE

[75] Inventors: Berndt Ekwall, Saltsjöbaden; Torbjörn Jakobsson, Saltsjö-Boo; Martin Peterson, Nacka, all of Sweden

[73] Assignee: Uniroc AB, Fagersta, Sweden

[21] Appl. No.: 28,247

[22] Filed: Mar. 10, 1993

[30] Foreign Application Priority Data

Mar. 31, 1992 [SE] Sweden ..... 9200995

[51] Int. Cl.[5] ..... E21B 1/06

[52] U.S. Cl. ..... 173/133; 173/128; 92/177

[58] Field of Search ..... 173/17, 104, 109, 91, 173/90, 130, 133, 135, 128; 92/177; 123/193.6, 193.4

[56] References Cited

U.S. PATENT DOCUMENTS

| | | | |
|---|---|---|---|
| 1,069,853 | 8/1913 | Carter | 173/109 |
| 2,013,744 | 9/1935 | Curtis | 173/109 |
| 3,180,236 | 4/1965 | Beckett | 92/177 |
| 3,270,821 | 9/1966 | Bassett et al. | 173/109 |
| 4,821,812 | 4/1989 | Ditzig | 173/17 |
| 4,831,919 | 5/1989 | Bruni | 123/193.6 |

*Primary Examiner*—Scott Smith

*Attorney, Agent, or Firm*—Mark P. Stone; Eric Y. Munson

[57] ABSTRACT

Down-the-hole drilling machine comprising a housing in form of a tube (1), a hammer piston (6) being movable to-and-fro in the tube and intended for impacting a drill bit (5). The hammer piston is at its ends provided with end sections in form of polygons with rounded corners (51, 52). These end sections are turned relative to each other an angle which is half as large as the angle between two adjacent corners.

3 Claims, 1 Drawing Sheet

DOWN-THE-HOLE DRILLING MACHINE

BACKGROUND OF THE INVENTION

The present invention relates to a down-the-hole drilling machine. More particularly the invention relates to the guiding of the hammer piston in a down-the-hole drilling machine.

In prior art down-the-hole drilling machines a common reason for breakdown has been that the hammer piston has seized upon bending of the surrounding tube. Such bending is caused because the drill hole becomes bent because of inhomogeneities in the ground. One effort to solve this problem has been to make the hammer piston with short guides. However, this has meant that the guides have been worn down quickly with increased air consumption and had functioning as a consequence.

SUMMARY OF THE INVENTION

The present invention, which is defined in the subsequent claims, aims at achieving a down-the-hole drilling machine which can stand comparatively large bending of the tube surrounding the hammer piston without seizure of the hammer piston.

BRIEF DESCRIPTION OF THE DRAWING

The invention is exemplified below with reference to the accompanying drawing in which.

DESCRIPTION OF THE PREFERRED EMBODIMENT OF THE INVENTION

Figure 1:
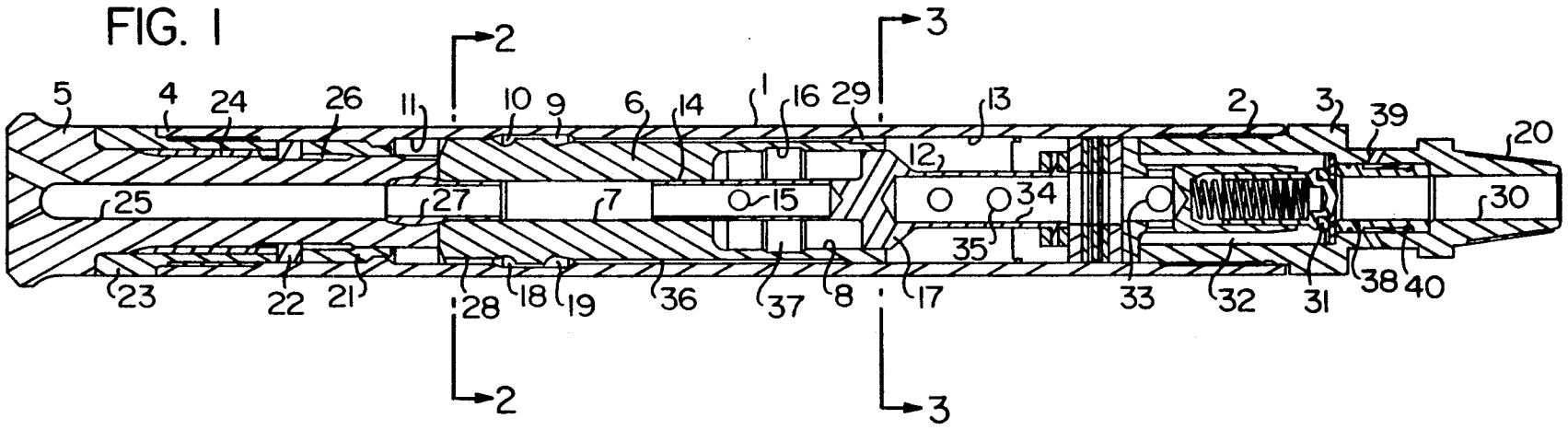
FIG. 1 shows a section through an embodiment of a down-the-hole drilling machine according to the invention with the hammer piston in impact position.
Figure 3:
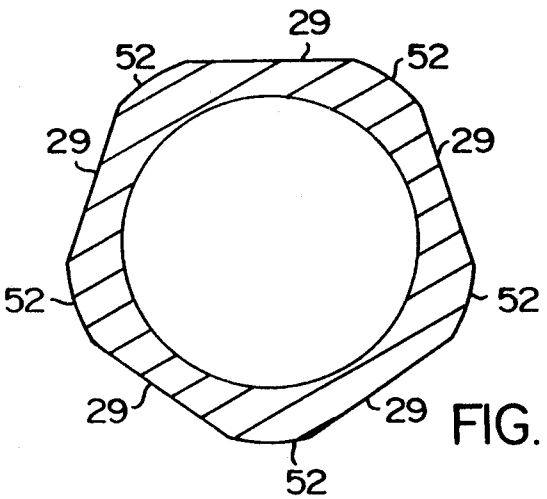
FIG. 3 shows a section through the hammer piston according to 3—3 in FIG. 1.
Figure 2:
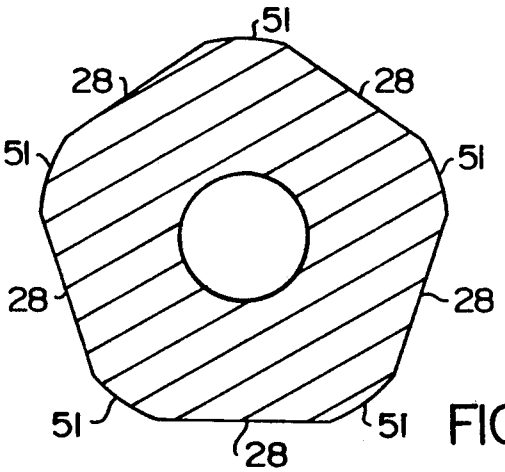
FIG. 2 shows a section through the hammer piston according to 2—2 in FIG. 1.

The shown down-the-hole drilling machine comprises a housing 1 provided with a rear end 2 and a front end 4. At the rear end a rear piece 3 is arranged for connecting the down-the-hole drill to a not shown tube string. The rear piece is for this purpose provided with a thread 20. At the front end a drill bit 5 is arranged. The drill bit is provided with a flushing channel 25 and a diameter reduction 26. The drill bit 5 is guided by bushings 21 and 23 and is prevented from falling out of the down-the-hole drilling machine by a stop ring 22. The bushing 23 is screwed into housing 1. The rotation of the not shown tube string is transferred via housing 1 and a splined connection 24 to drill bit 5. The drill bit is provided with tube piece 27 which together with the hammer piston 6, movable to-and-fro in the housing 1, forms a foot valve. Housing 1 is provided with a cutout 10 for cooperation with a ringformed section 9 on the hammer piston. The hammer piston is on each side of the ringformed section provided with a turndown 18 and 19 respectively. At the front end of hammer piston 6, which has the same diameter as the ringformed section 9, the hammer piston is provided with a number of substantially plane surfaces 28 distributed around the periphery of the hammer piston. Between the plane surfaces the end section is provided with rounded corners 51. The corners 51 preferably have the same radius of curvature as the tube 1. The rounded corners guide the hammer piston in the tube 1. The corners 51 together with the intermediate plane surfaces form a polygon, in the shown example a pentagon, with rounded corners. In the same way the rear section of the hammer piston, which has the same diameter as the ringformed section 9, is provided with a number of substantially plane surfaces 29 distributed around the periphery of the hammer piston and intermediate rounded corners 52 which have the same radius of curvature as the tube 1 and which guide the hammer piston in the tube. As is shown in the figures the two end sections are turned relative to each other about the longitudinal axis of the down-the-hole drilling machine an angle which is half as large as the angle between adjacent corners. In the shown example the turning is 36°. Through this arrangement of the guides one can have substantially larger bending of tube 1 without seizure of hammer piston 6. The hammer piston is internally provided with a central channel which comprises a first part 7 with a first diameter and a second part with larger diameter. The second part of the central channel comprises a zone 16 with larger diameter than other parts of the second part 8. This zone is situated at an intermediate part of the second part. Through this the hammer piston 6 can sealingly cooperate with a valve part 17 on an extension 12 of the rear piece 3 when the valve part is situated on either side of the zone 16 and allow passage of pressure medium when the valve part 17 is just in front of the zone 16. Pressure medium for the driving of the down-the-hole drilling machine is supplied via channel 30, check valve 31, chamber 32, holes 33, channel 34 and holes 35 to a second chamber 13 arranged about the extension 12 and continuously pressurised during operation. Chamber 13 is continuously connected with the turndown 19 via the passage past the plane surfaces 29 and the slot 36 between the hammer piston 6 and housing 1. A first chamber 11 situated in front of hammer piston 6 is continuously connected with the turndown 18 via the passage past the plane surfaces 28. The extension 12 is provided with a tubeformed part 14 which extends into the first part 7 of the central channel in the hammer piston. The tubeformed part is provided with holes 15 which form a pressure medium connection between the second part 8 and the first part 7 when the hammer piston is in the shown position. This pressure medium connection is controlled by the hammer piston 6. Because the tubeformed part 14 continuously extends into the first part 7 of the central channel the risk for damage on the tubeformed part and on the hammer piston 6 decreases. The rear piece 3 comprises a sleeve 38, about which a ring 40 of elastic material is arranged, and holes 39. At certain drilling conditions it is desirable to supply flushing medium at the rear end of the down-the-hole drilling machine. In such a case one can provide the sleeve 38 with radial holes under the elastic ring 40 which then will act as check valve.

The shown down-the-hole drilling machine functions in the following way. In the shown position the first chamber 11 is pressurised via the passage past the plane surfaces 29, slot 36, cutout 10 and the passage past the plane surfaces 28. The turndowns 18, 19 have as function to speed up the driving medium flow when the passage via the cutout 10 is opened during the forward movement of hammer piston 6. Room 37 is via holes 15, the first part 7 of the central channel and the flushing channel in connection with the surrounding pressure. As a result the hammer piston is driven backward. When hammer piston 6 has left tube piece 27 the first chamber 11 is in connection with flushing channel 25 and thus with ambient pressure. Valve part 17 on extension 12 is just in front of zone 16 so that pressure medium can pass from second chamber 13 to room 37. Furthermore, hammer piston 6 has cut off the pressure medium connection via holes 15. Through this the backward movement of hammer piston 6 is braked. This braking is amplified when zone 16 of the hammer piston has passed valve part 17. In this position the pressure increases rapidly in the closed room 37. As a result of this the hammer piston is quickly turned forward which makes a high working frequency with maintained high impact energy in the single impacts against the drill bit 5 possible. The possibilities to increase the working frequency is amplified by the speeding up of the pressure medium flow which is obtained by means of the turndowns 18, 19. Because the backward movement of the hammer piston is braked by means of a pressure medium cushion in room 37 which stores energy which can be used in the subsequent forward movement the consumption of pressure medium by the machine is decreased. Furthermore, the risk that the hammer piston should hit valve part 17 is decreased.

We claim:

1. Down-the-hole drilling machine comprising a housing formed as a tube (1), a rear piece (3) arranged at a rear end (2) of the tube, a drill bit (5) arranged at a front end (4) of the tube, a hammer piston (6) being movable to-and-fro in the tube for impacting against said drill bit, wherein the hammer piston is provided with a front guide near a front end of the hammer piston for cooperation with said tube and a rear guide near a rear end of the hammer piston for cooperation with said tube, said machine defining a longitudinal axis therein, characterized in that said front and rear ends of the hammer piston (6) are each configured in the form of a similar shaped polygon having rounded corners (51, 52) including at least two adjacent corners and defining a predetermined angle between said at least two adjacent corners which guide the hammer piston in said tube (1), and that the front and rear guides are oriented relative to each other about the longitudinal axis of the down-the-hole drilling machine at an angle which is less than the angle between said two adjacent corners of one of said similar polygons.

2. Down-the-hole drilling machine according to claim 1, characterized in that said polygons are pentagons.

3. The down-the-hole drilling machine according to claim 1 wherein said angle at which said front and rear guides are oriented relative to each other is substantially half as large as said angle between said two adjacent corners of one of said polygons.

* * * * *